United States Patent [19]

AbuJudom, II et al.

[11] Patent Number: 4,708,600

[45] Date of Patent: Nov. 24, 1987

[54] PIEZOELECTRIC FLUID PUMPING APPARATUS

[76] Inventors: David N. AbuJudom, II, 3220 Pilgrim Rd., Brookfield, Wis. 53005; Joseph P. Dougherty, 1601 Echo Valley Dr., Niles, Mich. 49120; Kevin M. Stengel, 5295 N. Mohawk Ave., Glendale, Wis. 53217

[21] Appl. No.: 832,227

[22] Filed: Feb. 24, 1986

[51] Int. Cl.[4] ..... F04B 17/00; F04B 35/00

[52] U.S. Cl. ..... 417/322; 417/415; 417/418; 310/328; 310/330; 310/332

[58] Field of Search ..... 417/322, 410, 415, 418; 310/332, 331, 330, 328

[56] References Cited

U.S. PATENT DOCUMENTS

| | | | |
|---|---|---|---|
| 2,842,067 | 7/1958 | Stevens | 310/26 |
| 3,222,462 | 12/1965 | Karmann et al. | 310/331 |
| 3,931,554 | 1/1976 | Spentzas | 417/418 |
| 4,496,871 | 1/1985 | Sumita et al. | 310/332 |
| 4,558,995 | 12/1985 | Furukawa et al. | 417/322 |
| 4,595,338 | 6/1986 | Kolm et al. | 417/322 |
| 4,625,137 | 11/1986 | Tomono | 310/317 |
| 4,629,926 | 12/1986 | Siegal | 310/331 |

FOREIGN PATENT DOCUMENTS

| | | | |
|---|---|---|---|
| 43226 | 3/1980 | Japan | 417/322 |
| 969160 | 9/1964 | United Kingdom | 310/330 |
| 806896 | 3/1981 | U.S.S.R. | 417/322 |

OTHER PUBLICATIONS

Aronson, "Discovering Piezoelectrics", *Machine Design,* Jun. 21, 1984, pp. 73–77.

*Primary Examiner*—Carlton R. Croyle
*Assistant Examiner*—Donald E. Stout

[57] ABSTRACT

A piezoelectric fluid pumping apparatus includes pumping means for supplying a fluid under pressure and an energizer arranged in driving relationship therewith. The energizer includes a generally planar flexure member having first and second piezoelectric laminates supported thereon. The flexure member includes a first edge and a second edge, the edges being resiliently constrained for substantially preventing longitudinal movement thereof when an electrical signal is applied to the laminates. Preferred embodiments of the flexure member include bimorphous, biunimorphous and quadrimorphous piezoelectric structures.

14 Claims, 15 Drawing Figures

PIEZOELECTRIC FLUID PUMPING APPARATUS

This invention relates generally to fluid pumping devices and more particularly, to a low power, electrically driven fluid pumping apparatus incorporating a piezoelectric energizer.

Fluid pumping devices are in wide use and incorporate a variety of mechanical and electromechanical drive mechanisms for pumping a fluid at a pressure and such devices range in size from large to extremely compact. Examples of such devices which use piezoelectric materials are shown in an article in MACHINE DESIGN magazine, the issue of 21 June, 1984, a photocopy of which is attached hereto as Appendix I. An example of an apparatus which may be useful in pumping fluids is shown and described therein, uses a saggital linkage and relies for its operation upon the enlargement and contraction of the diameter of a piezoelectric stack which is sequentially energized and de-energized.

One application for fluid pumping apparatus is in heating, ventilating and air conditioning (HVAC) pneumatic control systems frequently installed in larger buildings. In such systems, one or two relatively large fluid pumps, typically pneumatic pumps, are disposed within the building with a connected pneumatic bus networked throughout for providing a source of motive power. Air from this bus is controllably applied to pneumatic cylinders to position dampers, valves and the like for temperature control.

A variant approach to the use of pneumatic pressure for positioning dampers and valves is to provide a compact pneumatic pump constructed as an integral part of the pneumatic cylinder being actuated, thereby eliminating the need for large pumps and the networked bus and greatly simplifying modifications to the system or building. An example of an oscillating, electromagnetic pump which may be adapted to installation within a pneumatic cylinder is shown in U.S. Letters Patent No. 3,784,334. While pumps of the type shown in that patent have heretofore been generally satisfactory, they tend to have a weight and complexity somewhat disproportionate to their output capability. Additionally, they frequently require the application of undesirably high values of electrical power. A low power fluid pumping apparatus which is light weight, which requires relatively low power levels, which can provide an output pressure commensurate with that required by commonly-used pneumatic actuating cylinders and which lends itself to easy integration within such a cylinder would be an important advance in the art.

SUMMARY OF THE INVENTION

In general, the inventive piezoelectric fluid pumping apparatus includes pumping means for supplying a fluid under pressure and an energizer arranged in driving relationship therewith. The energizer includes a generally planar flexure member having first and second piezoelectric laminates supported thereon. The flexure member includes a first edge and a second edge, the edges being resiliently constrained for substantially preventing longitudinal movement thereof when an electrical signal is applied to the laminates. Preferred embodiments of the flexure member include bimorphous, biunimorphous and quadrimorphous piezoelectric structures.

It is an object of the present invention to provide a fluid pumping apparatus which utilizes a piezoelectric energizer.

Another object of the present invention is to provide a fluid pumping apparatus which is compact, light weight and readily integrated into the structure of a pneumatic cylinder.

Still another object of the present invention is to provide a fluid pumping apparatus which utilizes the flexure characteristics of a piezoelectric energizer for powering one or more fluid pumps.

Another object of the present invention is to provide a fluid pumping apparatus capable of providing a fluid at a pressure commonly employed in HVAC pneumatic control systems. How these and other objects of the invention are accomplished will become more apparent from the detailed description thereof taken in conjunction with the accompanying drawing.

DESCRIPTION OF THE PREFERRED EMBODIMENTS

Figure 1:
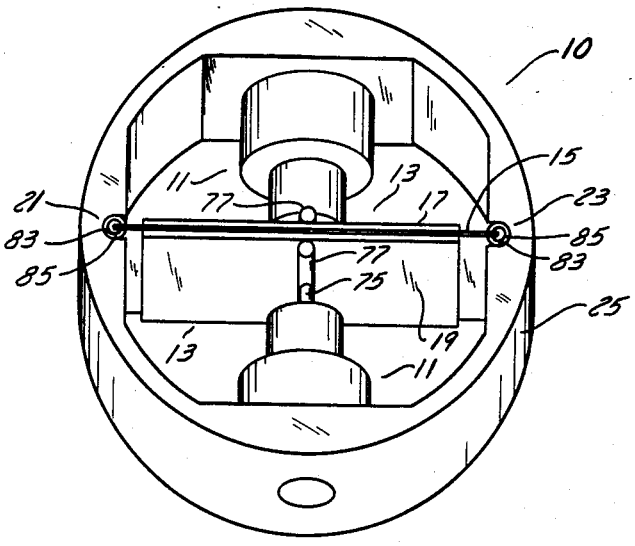
FIG. 1 is a perspective side elevation view of an embodiment of the pumping apparatus of the invention which uses a generally circular frame.
Figure 2:
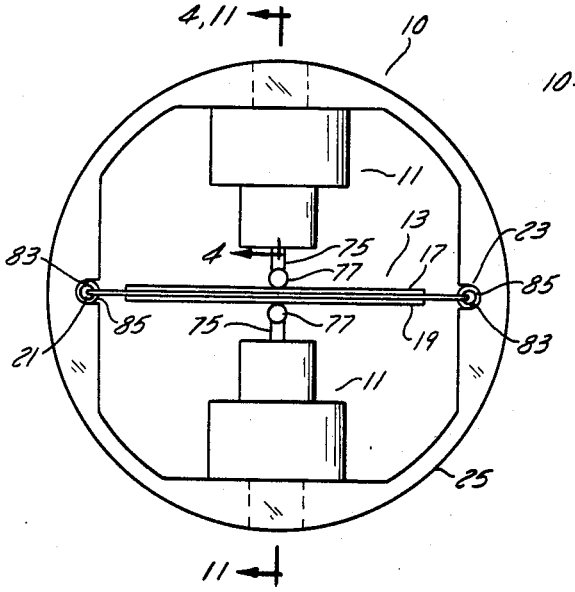
FIG. 2 is a side elevation view of the embodiment of FIG. 1.
Figure 11:
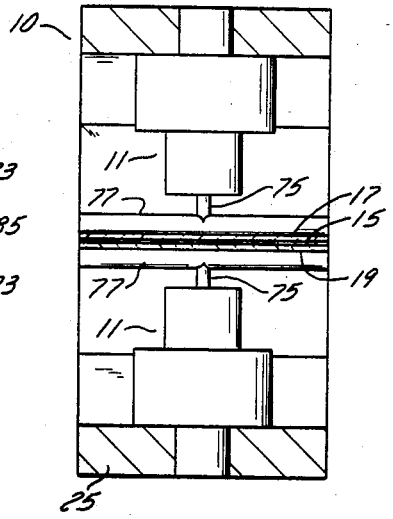
FIG. 11 is an end elevation view of the apparatus of FIG. 2 taken along the plane 2—2 with portions shown in cross section and other portions shown in full representation.
Figure 3:
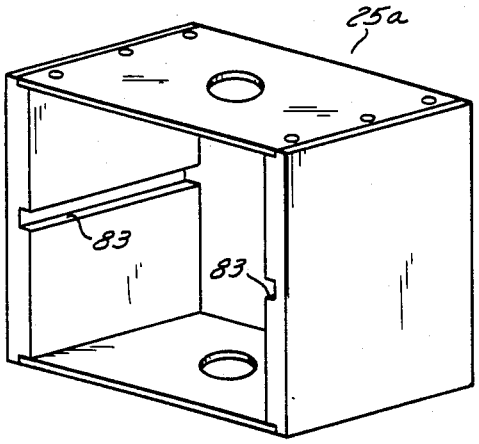
FIG. 3 is a perspective side elevation view of another frame useful with the apparatus of the embodiments.

Referring first to FIGS. 1 and 2, the fluid pumping apparatus 10 of the present invention is shown to include pumping means 11 for supplying a fluid under pressure. An energizer 13 is arranged in driving relationship to the pumping means 11 and includes a generally planar flexure member 15 having first and second piezoelectric laminates, 17, 19 respectively, supported thereon. The flexure member 15 includes a first edge 21 and a second edge 23, the edges 21, 23 being resiliently constrained for substantially preventing longitudinal movement thereof while yet permitting lateral oscillating movement of the energizer 13 when an electrical signal is applied. The pumping means 11 and the energizer 13 may be supported by a frame 25 selected to be of a size and shape for convenient integration with a pneumatic cylinder. If such integration is unnecessary, a convenient frame 25*a* may be configured as in FIG. 3. It is to be appreciated that the energizers 13 depicted in FIGS. 1, 2, 8–12 are portrayed in simplified form for easier understanding and details of the preferred embodiments of the energizers 13 are shown and described following with reference to FIG. 4.

Figure 4:
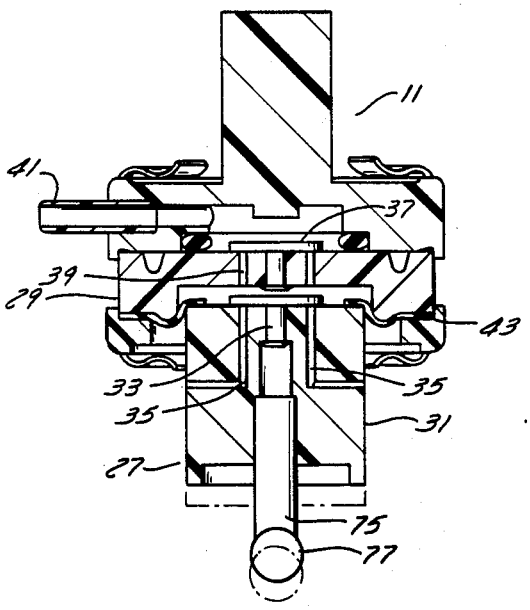
FIG. 4 is a cross-sectional side elevation view of a pump component of the apparatus of FIG. 2 as viewed along plane 4—4 thereof.
Figure 5:
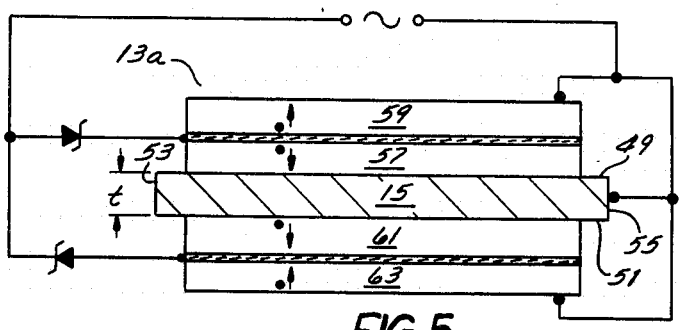
FIG. 5 is an enlarged side elevation view of a quadrimorph energizer, a component of one embodiment of the invention.
Figure 6:
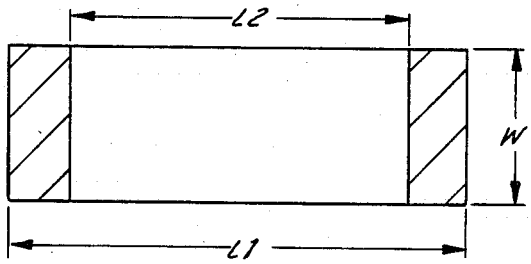
FIG. 6 is a top plan view of the energizer components of FIGS. 1, 2, 7, 8 and 9.

More particularly, the pumping means 11 is preferably embodied as one or two pumps 27 of the reciprocating, check valve type as shown and described in U.S. Letters Patent No. 3,936,245 which is incorporated herein by reference. For ease of manufacturing, it is preferred that the pumps 27 be positionable along their longitudinal axis, that axis being normal to the longitudinal axis of the energizer 13. As further described below, this will permit adjustment to a position whereby the pumps 27 can provide their maximum pressure capability. Adjustment may be accomplished by any known, convenient means such as an adjusting screw (not shown) or the like and this arrangement may be used, irrespective of whether the pumping means 11 is embodied as one or two pumps 27. Referring to FIG. 4, the pump 27 is shown to include a stationary body 29, a movable pumping piston 31 and a resilient inlet check valve 33 cooperating with inlet passages 35 for filling the pump 27 with pneumatic fluid during the suction stroke and for confining it during the pumping stroke. A discharge check valve 37 and discharge passages 39 permit the compressed, pumped fluid to be expelled to the outlet 41 during the pumping stroke. The piston 31 is slidably movable in the body 29 and supported Referring next o FIG. 5, one preferred embodiment of the energizer 13, sometimes termed a quadrimorph energizer 13*a*, is shown to include a flexure member 15 formed of a thin, generally planar electrically conductive material such as one quarter hard brass, titanium or steel and has first and second generally planar surfaces, 49 and 51 respectively, a first end 53 and a second end 55. A first piezoelectric laminate 57 is disposed on the first surface 49 while a second piezoelectric laminate 59 is supported by the first laminate 57. Similarly, a third laminate 61 is disposed upon the second surface 51 and a fourth laminate 63 is supported by the third laminate 61. The piezoelectric laminates 57, 59, 61, 63 of this embodiment and those of other embodiments disclosed herein are preferably formed of a lead zirconium titanate based ceramic although other known piezoelectric materials such as barium titanate may also be used, but perhaps with some sacrifice in maximum deflection. As best seen in FIGS. 5 and 6, the flexure member 15 of the embodiments will have a thickness "t" of 12–16 mils, a mil being one thousandth of an inch. The laminates 57, 59, 61, 63 as well as those of other embodiments will be of uniform thickness one to the other and will have a preferred thickness in the range of 6–8 mils. An exemplary energizer 13 will have a flexure member 15 with a length L1 of approximately 3 inches, a width W of approximately 1.5 inches while the length L2 of the laminates will be in the range of 2.5 inches to 2.75 inches and centered longitudinally on the flexure member 15. The orientation of the polarized laminates 57, 59, 61, 63 is preferably as shown in FIG. 5 where the dot is closely adjacent to and identifies those surfaces which are of positive polarity and which lie parallel to the surface of the flexure member 15.

The piezoelectric laminates 57, 59, 61, 63 are preferably selected in view of the stroke and displacement of the pumps 27 which define the embodiment of the pumping means 11 and the maximum desired output pressure from the apparatus 10.

In general, for a simply supported piezoelectric beam where the laminates are energized in series, the free displacement, under static conditions is in accordance with the following equation $$X=3d_{31}L^2V(1+t/T)/8T^2$$

where t = the combined thickness of the flexure member 15 and epoxy. When $t/T<<<1$, then the equation reduces to $$X=3d_{31}L^2V/8T^2$$

The blocked force $F_b$, is given by the product of the free deflection, $d_f$, and the stiffness, K. In the dynamic mode, the displacement is given by $$X=\frac{F}{K+KP}\cdot\left(\left[1-\left(\frac{f}{fr}\right)^2\right]^2+\left[\frac{f}{frQ}\right]^2\right)^{-\frac{1}{2}}$$

However at frequencies well below resonance or in the static mode, $f\rightarrow 0$ and $K_p\rightarrow 0$ and $X=F/K$ or $F=XK$.

In the above formulas, X is the deflection in meters, $d_{31}$ is the piezoelectric coefficient for specific materials, L, W and T are length, width and thickness respectively in meters and V is the peak voltage in volts. Q is the Quality Factor, f and $f_r$ are respectively the frequency and the resonant frequency of the system, and Kp is the stiffness associated with pumping the fluid.

Affixation of the first laminate 57 and the third laminate 61 to the flexure member 15 and of the second laminate 59 and the fourth laminate 63 to the first laminate 57 and third laminate 61, respectively, is preferably by a low viscosity adhesive which will prevent the laminates from shearing movement with respect to one another. One such adhesive is LOCTITE no. 326 used with N primer. An epoxy cement having a conductive metal such as powdered nickel blended therewithin is also satisfactory. A method for applying the adhesive is to spray the primer on one surface, e.g., the first surface 49 of the flexure member 15 and to apply the adhesive to the mating surface, e.g., the negatively polarized surface of the first laminate 57.

Figure 7:
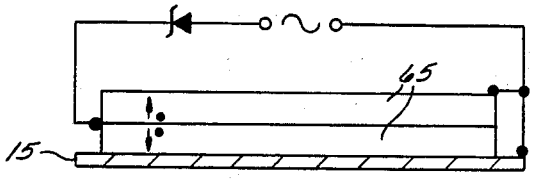
FIG. 7 is an enlarged side elevation view of a biunimorph energizer.
Figure 8:
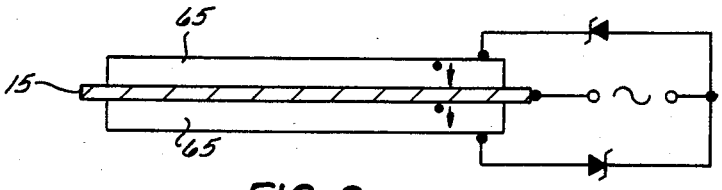
FIG. 8 is an enlarged side elevation view of a parallel bimorph energizer.
Figure 10:
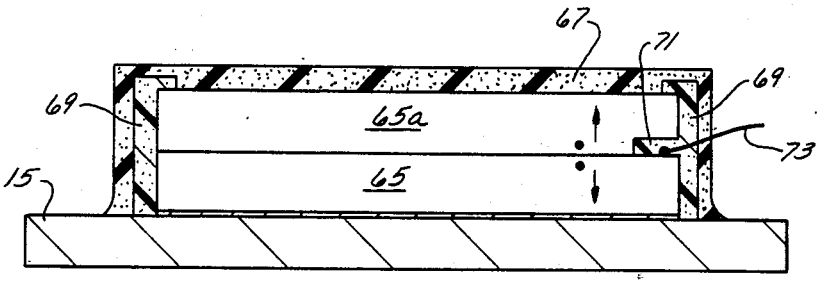
FIG. 10 is a side elevation view of a portion of the energizer of FIG. 7 and including a conductive overlay thereon.

FIG. 7 illustrates what may be termed a biunimorphic energizer while FIG. 8 illustrates a bimorphic energizer, the dimensions of a preferred embodiment of the generally-depicted laminates 65 and flexure members 15 are selected to maximize the length to thickness ratio for optimum deflection. The simplified circuitry shown in FIGS. 5, 7 and 8 are to illustrate the manner in which an energizer 13 may be connected to an electrical drive circuit for applying an electrical signal.

Because the laminates 65 used to construct the energizer 13 are rather brittle and may develop a small fracture when the energizer 13 is caused to oscillate, thereby resulting in electrical discontinuity of the electrode surface, it may be necessary to provide a compliant conductive layer to preserve electrical integrity of the laminate 65. Accordingly and referring next to FIG. 10, it may be desirable to overlay the outermost laminate 65*a* with a layer or jacket 67 formed of conductive silicone rubber and arranged to contact substantially the entirety of the outermost surface of laminate 65*a*. It will thereby be electrically connected to flexure member 15 while yet being isolated from the surface electrode of laminate 65 by the non-conductive epoxy layer 69. When passing lead wire 73 through the jacket 67, care is to be taken to electrically insulate the wire 73 and the jacket 67 from one another. A small recessed notch 71 may be formed at one corner of laminate 65*a* to permit the affixation of an electrical lead wire 73.

Figure 12:
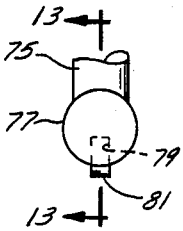
FIG. 12 is an end elevation view of a crossbar component of the apparatus as seen in FIGS. 1, 2 and 11.
Figure 13:
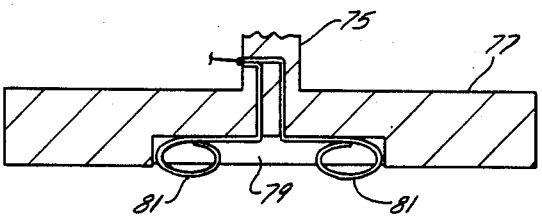
FIG. 13 is a cross-sectional side elevation view of the crossbar of FIG. 12 taken along the plane 13—13.
Figure 14:
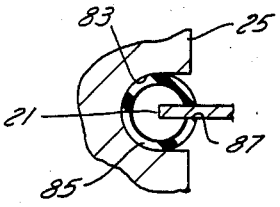
FIG. 14 is an enlarged side elevation view of a portion of the apparatus of FIGS. 1 or 2 illustrating the manner of supporting a flexure member within a frame of the apparatus.

Referring again to FIGS. 2, 5, 7, 8 and 10 and irrespective of whether a jacket 67 is employed, it will be convenient to make electrical connections to the outer surface electrodes of the laminates 59 and 63, 65 or 65*a* and to the flexure member 15 by employing a pump stem 75 formed of a dielectric material and including a cylindrically-shaped, dielectric crossbar segment 77, the longitudinal axis of which is parallel to the surfaces 49, 51 and normal to the longitudinal axis of the flexure member 15. The stem 75 and its crossbar segment 77 thereby define a generally T-shaped structure. Referring to FIGS. 12 and 13, the segment 77 may have a slot 79 formed therein along a portion of its length and sized to receive a pair of resilient, electrically conductive contacts 81 which are electrically coupled together and which may be brought out through the stem 75 to receive an electrode connection. When electrical connection to the crystal, 65 generally, or jacket 67, as the case may be, is formed in this way, the energizer 13 is thereby lightly supportingly clamped and in the case of parallel-connected laminates as shown in FIG. 5, the connection also performs the function of a more complex arrangement known as a wrap-around electrode.

Figure 15:
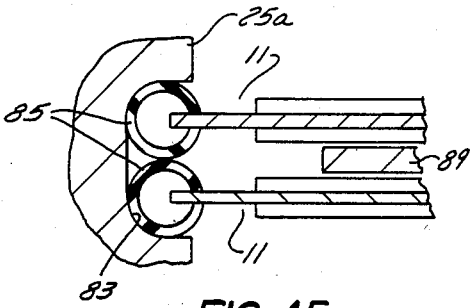
FIG. 15 is an enlarged side elevation view illustrating the manner in which tandem energizers may be supported within a frame of the apparatus.
Figure 9:
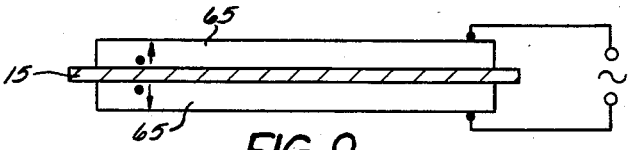
FIG. 9 is an enlarged side elevation view of a series bimorph energizer.

When the apparatus 10 is constructed and arranged as described above, it will be apparent that the pumping means 11 will be caused to reciprocate and therefore supply fluid under pressure by the oscillatory action of the energizer 13. In order to cause the energizer 13 to deform by bending or bowing, rather than by elongating, to achieve this oscillatory action, it is preferred that the edges 21, 23 or ends 53, 55 of the flexure member 15 be supported in a manner to restrain elongation while yet permitting bending. One way to achieve this result is shown in FIGS. 1, 2, 3 and 14 wherein the side walls of the frame 25 or 25*a* have formed therewithin a pair of generally C-shaped notches or grooves 83 having a curved portion sized to receive a cylindrically shaped resilient, hollow support tube or sleeve 85. A preferred support tube 85 useful with energizers 13 having the general dimensions described above may be formed of silicon rubber of about 150 mils outer diameter and a wall thickness of about 50 mils. A straight, longitudinal cut 87 is made throughout the length of the support tube 85 and an edge 21, 23 or end 53, 55 of the flexure member 15 inserted therewithin for support. Placement is preferably in a manner such that the edge 21 or end of the flexure member 15 is generally coincident with the longitudinal center axis of the tube 85 and thereby avoids contact with that portion of the tube wall opposite the cut 87. If a higher pumping pressure capability is desired, a pair of energizers 11 may be arranged and supported in tandem as shown in FIG. 15 which illustrates the use of two bimorph type energizers 11 as depicted in FIG. 8 and which are electrically insulated one from the other by a relatively thin layer of dielectric material 89 and triple energizer stacks may also be feasible.

Because an energizer 11 constructed as a bimorph as generally depicted in FIG. 8 has, when oscillating at its resonant frequency and therefore at large amplitudes, a greater tendency to crack unless its travel is limited, it has been found desirable to adjust the position(s) of the pump(s) 27 to reduce the pump clearance volume, thereby limiting the amplitude of energizer oscillation. It is to be appreciated that if the pumping means 11 embodies only a single pump 27, it is preferable to install a resilient snubber or spring (not shown) on that side of the energizer 13 opposite the pump 27 employed and in order to limit the oscillation amplitude of the energizer 13.

While most HVAC pneumatic control systems operate in the range of 0–20 p.s.i.g., it is believed that highly satisfactory positioning control of pneumatic cylinders may result from the use of pressures in the 0–10 p.s.i.g. range. In that event, a bimorph energizer 13 as shown in FIG. 8 has been found to be preferred for the application and if a higher pressure capability is required, the tandem bimorph of FIG. 15 is preferred.

Piezoelectric fluid pumping apparatus 10 constructed in accordance with the above teachings are preferably driven at their resonant frequency for greatest amplitude of oscillation. In some applications, it may be desirable to construct a cylinder into which apparatus 10 is integrated to permit bleeding its internal pressure to ambient level. In that event, a parallel bleed port and actuating piezo or solenoid (not shown) may be coupled to outlet 41.

While only a few preferred embodiments of the inventive apparatus 10 have been shown and described, the invention is not intended to be limited thereby but only by the scope of the claims which follow.

We claim:

1. A piezoelectric fluid pumping apparatus including:

pumping means, including a fluid inlet for filling said pumping means with fluid and a fluid outlet for supplying therethrough fluid under pressure, a pumping piston and means for operating said pumping piston;

an energizer arranged in driving relationship to said means for operating said pump piston of said pumping means and including a generally planar flexure member having first and second piezoelectric laminates supported thereon;

said flexure member including a first edge and a second edge, said edges being resiliently constrained for substantially preventing longitudinal movement thereof when an electrical signal is applied to said laminates.

2. The invention set forth in claim 1 wherein said flexure member includes a pair of opposed, generally planar surfaces, each having one of said laminates disposed thereon.

3. The invention set forth in claim 1 wherein said flexure member includes a first, generally planar surface, said first laminate being disposed on said planar surface, said second laminate being supported by said first laminate.

4. A piezoelectric fluid pumping apparatus including:

a frame;

pumping means supported by said frame for supplying a fluid under pressur and including a fluid inlet, a pumping chamber, and a fluid outlet;

a piezoelectric energizer supported by said frame, arranged in driving relationship to said pumping means and including a generally planar, electrically conductive flexure member having a plurality of piezoelectric laminates supported thereby;

said flexure member including a first end and a second end, each of said ends being received within a respective groove formed in said frame and supported therewithin by a sleeve interposed between the end and its respective groove, said flexure member thereby being substantially constrained from elongating when an electrical signal is applied to said energizer.

5. The invention set forth in claim 4 wherein said pumping means includes an actuating stem formed of a dielectric material and having an electrically conductive contact incorporated therewith, said contact being disposed intermediate said stem and one of said piezoelectric laminates and in electrical contact with said one of said laminates, said contact thereby providing an electrical connection for the application of said signal to said energizer.

6. The invention set forth in claim 5 wherein said flexure member includes a pair of opposed, generally planar surfaces, each having one of said laminates disposed thereon.

7. The invention set forth in claim 5 wherein said flexure member includes a first, generally planar surface, said first laminate being disposed on said planar surface, said second laminate being supported by said first laminate.

8. An apparatus for delivering a fluid at a pressure and including:

a support frame;

at least one pump supported by said frame for delivering said fluid at a pressur and including a fluid inlet, a pumping chamber, and a fluid outlet;

at least one piezoelectric energizer disposed in driving relationship to said pump and having an electrically conductive flexure member and a plurality of piezoelectric laminates supported thereon, said flexure member including first and second edges resiliently supported by said frame and constrained for substantially preventing longitudinal movement thereof while yet permitting lateral oscillating movement of said energizer;

said pump including an actuating stem formed of a dielectric material and having at least one conductive contact in electrical connection with one of said laminates.

9. The invention set forth in claim 8 wherein said actuating stem includes a crossbar segment having its longitudinal axis normal to that of the energizer and said contact is supported by said segment.

10. The invention set forth in claim 9 wherein said flexure member includes a first surface and a second surface, each having one of said laminates adhering thereto to define a bimorph energizer.

11. The invention set forth in claim 9 wherein said flexure member includes a first surface having a first laminate adhering thereto, said first laminate having a second laminate adhering thereto to define a biunimorph energizer.

12. The invention set forth in claim 8 wherein said apparatus includes two pumps and two piezoelectric energizers, said energizers being resiliently supported by said frame in a tandem, generally parallel relationship one to the other.

13. The invention set forth in claim 11 wherein said energizers are of the bimorph type.

14. The invention set forth in claim 11 wherein said energizers are of the biunimorph type.

* * * * *

UNITED STATES PATENT AND TRADEMARK OFFICE

CERTIFICATE OF CORRECTION

PATENT NO. : 4,708,600

DATED : November 24, 1987

INVENTOR(S) : David N. AbuJudom, II; Joseph P. Dougherty; Kevin M. Stengel

It is certified that error appears in the above-identified patent and that said Letters Patent are hereby corrected as shown below:

Column 3, Line 37 "supported" should be --therein by a resilient diaphragm 43.--

Column 3, Line 38 "o" should be --to--

Column 6, Line 67 "pressur" should be --pressure--

Column 8, Line 2 "pressur" should be --pressure--

Signed and Sealed this

Twenty-fifth Day of October, 1988

*Attest:*

DONALD J. QUIGG

*Attesting Officer*

*Commissioner of Patents and Trademarks*